United States Patent [19]

Sandmeyer

[11] Patent Number: 4,925,143

[45] Date of Patent: May 15, 1990

[54] MULTIPLE CLIP HOLDING ASSEMBLY

[76] Inventor: John J. Sandmeyer, 134 S. Courtland, Topeka, Kans. 66606

[21] Appl. No.: 421,854

[22] Filed: Oct. 16, 1989

[51] Int. Cl.[5] ..... A63F 9/00

[52] U.S. Cl. ..... 248/441.1; 248/451; 273/148 A; 40/124

[58] Field of Search ..... 248/441.1, 451, 473, 248/466, 469; 273/148 A; 40/124, 658, 666, 606

[56] References Cited

U.S. PATENT DOCUMENTS 4,291,852 9/1981 Delmonte ..... 40/124

*Primary Examiner*—Alvin C. Chin-Shue

*Attorney, Agent, or Firm*—Hovey, Williams, Timmons & Collins

[57] ABSTRACT

A multiple clip holding assembly (10) is advantageously provided to hold up to four bingo cards (56–62) for optimum use of space in the course of play. Holding compartments (44,48) are defined by respective portions of first leg (40), first upright member (22) and wall structure (16). Holding compartments (46, 50) are defined by respective portions of second cantilevered member (32), first cantilevered member (24) and wall structure (16). Cards (56–62) are respectively held in holding compartments (44–50) in a releasable, frictional fashion due to the biasing action of endmost portions (34) and lowermost portions (26). In an alternative embodiment, top clip (64) may be used to engage topmost portions of top cards (56,60) for further stability.

6 Claims, 1 Drawing Sheet

MULTIPLE CLIP HOLDING ASSEMBLY

BACKGROUND OF THE INVENTION

1. Field of the Invention

This invention relates to a multiple clip holding assembly of simple yet highly effective construction which has numerous advantages including easy portability, stability and compactness. More particularly, it is concerned with an assembly having a plurality of releasable clip compartments for holding cards at transverse orientations for ease of viewing and manipulation by the user.

2. 2. Description of the Prior Art

Many people who play bingo use multiple cards during one session for enhanced enjoyment and increasing the odds of winning. The problem with such multiple use is that it is difficult to physically organize all of the cards so as to enable the ready visual inspection and manipulation thereof. If all the cards are oriented in coplanar fashion such as by laying them all on a table or the like, the player ends up having to use a great deal of surface area, thereby decreasing the pleasure and efficiency of play.

What is needed is a device for more efficiently organizing bingo cards so that a user has better access to each card played. In particular, what is needed is a device which enables a player to orient the cards transversely to one another, that is to say three dimensionally.

SUMMARY OF THE INVENTION

The problems outlined above are in large measure solved by the multiple clip holding assembly in accordance with the present invention. That is say, the holding assembly hereof is compact, stable and conveniently orients up to four bingo cards in a limited amount of space.

The holding assembly in accordance with the present invention broadly includes a forward segment, a rearward segment and a wall. The forward segment includes two inverted L-shaped units, each having an upright member and a cantilevered member. The rearward segment is operably coupled with the forward segment by the noted wall and includes an inverted, U-shaped support member The support member and the first and second units are configured to create compartments for releasably, frictionally engaging and supporting portions of the inserted bingo cards in such a manner that two of the bingo cards are oriented transversely to the other two bingo cards.

In preferred forms, the endmost portions of the cantilevered member of the second unit and the lowest portions of upright member of the first unit are flexible and biased so that the act of inserting the bingo cards tilts the flexible portions outwardly to a holding orientation. In particularly preferred forms, the holding assembly includes a separate top clip which utilizes two facially opposed clip members to clip the top portions of two upstanding bingo cards together so as to add further stability thereto.

BRIEF DESCRIPTION OF THE PREFERRED EMBODIMENT

Figure 1:
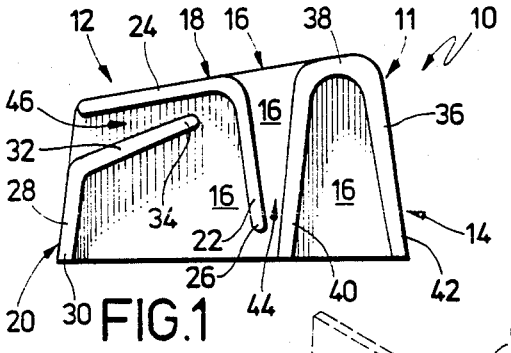
FIG. 1 is a side elevational view of the preferred multiple clip holding assembly in accordance with the present invention.

Referring now to the drawing in general, and FIG. 1 in particular, a multiple clip holding assembly 10 in accordance with the invention broadly includes a body 11 having forward segment 12, rearward segment 14 and wall structure 16. The holding assembly 10 is configured to hold up to four bingo cards in a convenient, accessible fashion.

In more detail, forward segment 12 includes first and second, mated, spaced apart units 18, 20 of inverted, L-shaped configuration. The units 18, 20 can be constructed of any durable, adequately rigid material but with flexibility in selected portions as will be discussed below. Either metal or a synthetic resin would be suitable.

First unit 18 has an upright member 22 and a cantilevered member 24 as shown. Upright member 22 has lowermost portions 26 which are somewhat flexible. Lowermost portions 26 define a substantially upright plane which tilts with the flexing of portions 26. Portions 26 are biased in a first orientation as shown (for the second or distended orientation see FIG. 4).

Second unit 20 includes an upright member 28 having a support surface-engaging end 30 and a cantilevered member 32. Cantilevered member 32 has flexible, endmost portions 34 which are distal from upright member 28 and define a plane slightly inclined from horizontal in a first orientation as shown (for the second, substantially horizontal orientation see FIG. 4).

Rearward segment 14 includes a support member 36 having a bight 38, a first leg 40 and a second leg 42.

Figure 3:
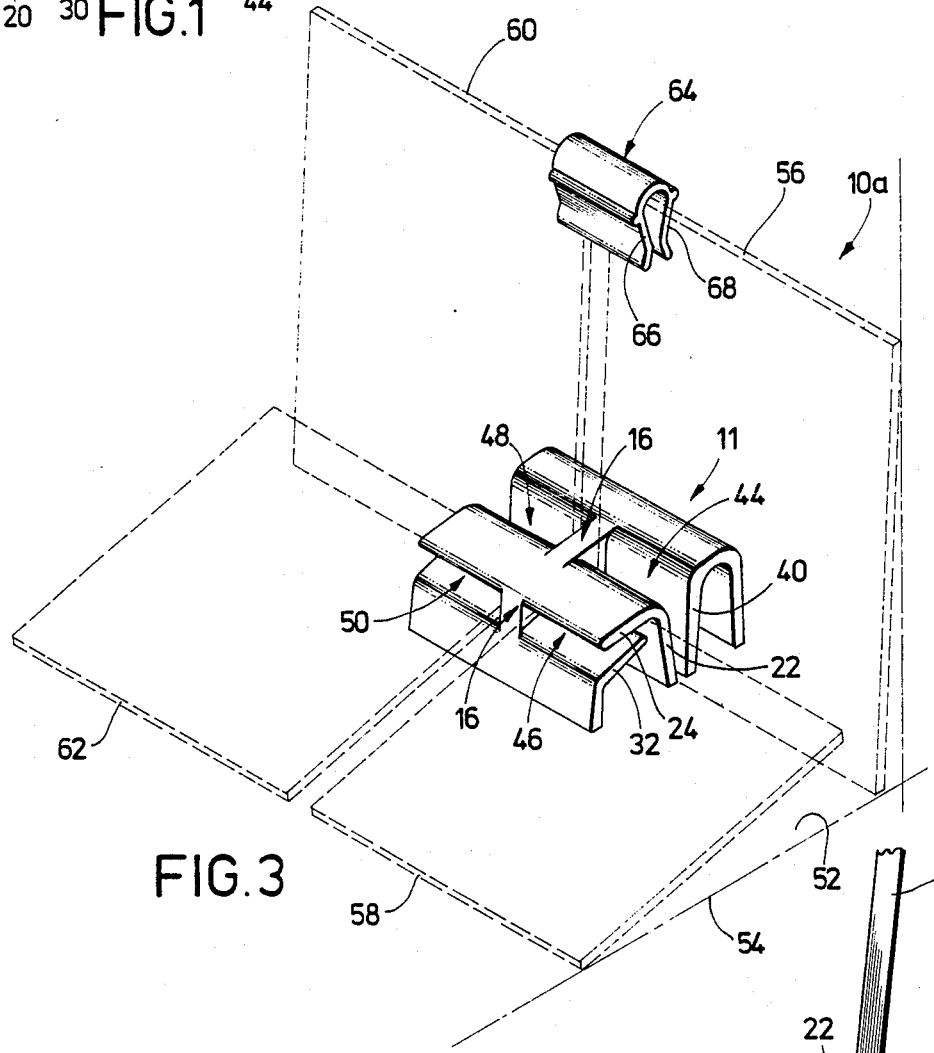
FIG. 3 is a perspective view of the alternative embodiment, along with four bingo cards, shown in phantom.

Referring to FIG. 3, wall structure 16 serves to equally divide first unit 18, second unit 20 and support member 36 along the respective lengths thereof at about the respective midway points. Thus, four holding compartments 44–50 are formed (only the first and second holding compartments 44, 46 are visible in FIG. 1). Holding compartments 44–50 are said to be divided into a first pair and a second pair. The first pair of holding compartments 44, 48 is defined by respective portions of first leg 40, first upright member 22 and wall structure 16. The second pair of holding compartments 46, 50 is defined by respective portions of second cantilevered member 32, first cantilevered member 24 and wall structure 16.

Still referring to FIG. 3, a support surface 52 is indicated by line 54 and may be a table or desk top or the like, as long as it is sufficiently stable and flat for the purpose of playing bingo. Corresponding with the holding compartments 44–50 are four bingo cards 56–62 suitable for insertion therein. It will be noted that the first pair of cards 56, 60 are substantially transverse to support surface 52 while second and fourth cards 58, 62 are slightly inclined from being parallel with support surface 52. First and third cards 56, 60 are essentially coplanar as are second and fourth cards 58, 62.

Figure 2:
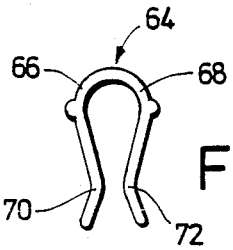
FIG. 2 is a side elevational view of a top clip used in an alternative embodiment of the present invention.

FIG. 3 shows an alternative embodiment, in that holding assembly **10*a* includes body 11 and top clip 64. Top clip 64 is of a generally U-shaped inverted configuration so as to present two facially opposed clip members 66, 68 connected at one end. As can best be seen in FIG. 2, each of the clip members includes inwardly sloped, inwardly biased portions 70, 72**.

Figure 4:
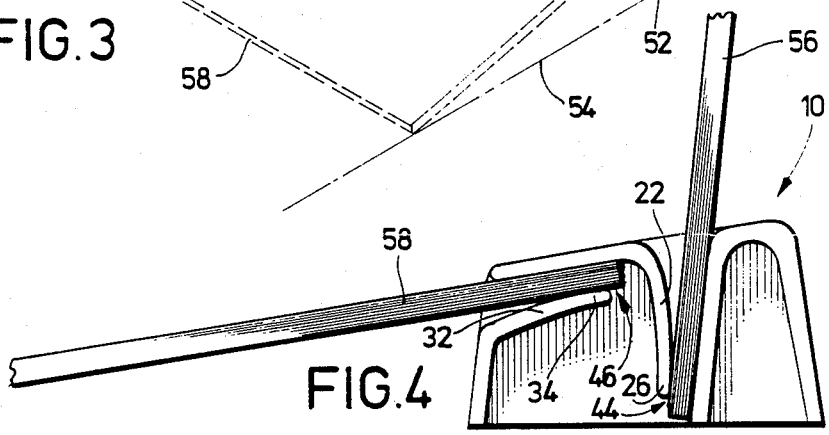
FIG. 4 is a partially cutaway view of the embodiment of FIG. 1 with two bingo cards inserted therein.

Holding assembly 10 of the preferred embodiment is illustrated in use at FIG. 4. It will readily be seen that as first bingo card 56 is inserted into first holding compartment 44 the lowermost portions 26 of first upright member 22 are shifted to the second orientation. Likewise, end-most portions 34 of second cantilevered member 32 are shifted downwardly to the second orientation as second bingo card 58 is inserted into second holding compartment 46. Thus, each bingo card inserted into a respective holding compartment is frictionally, releasably held by the holding assembly 10 in a postion suitable for visual inspection and manipulation by the user. Each card is then easily read and accessible for optimum bingo play. It will be readily appreciated that many styles of bingo cards such as those with windows in the squares and the like, can be used in the substantially upright position, such as card 56 in FIG. 4. Each card is simply removed by manually pulling it out of the respective holding compartment.

In the alternative embodiment depicted in FIG. 3, the cards are inserted into the respective holding compartments and then top clip 64 is selectively, downwardly positioned on the topmost portions of the first bingo card 56 and third bingo card 60 so that top clip 64 adds further stability to holding assembly **10*a* and the cards 56–62. The sloping and biasing of portions 70, 72 insure that top clip 64 will firmly hold the cards as desired. Of course, if the top clip 64 is not desirable in a given use, the top clip 64 may simply be put aside and the body 11 is used exactly as depicted in FIG. 4**. It will be readily appreciated by those skilled in the art that the dimensions of the holding compartments, as well as those of the top clip, will be designed with the thickness of standard bingo cards in mind.

I claim:

1. A multiple clip holding assembly adapted to rest on a support surface for releasably holding two pairs of bingo cards so that the cards are held in a position suitable for a user to visually inspect and manipulate the cards in a convenient fashion, the assembly comprising:

an integral body presenting a forward card-holding segment, a rearward card-holding segment, and wall means interconnecting said segments, said forward segment including first and second, mated, spaced apart units of inverted verted, generally L-shaped configuration, each of said units presenting an upright member and a cantilevered member extending from the upper end thereof, said upright member of said second unit having a support port surface-engaging lower end, said cantilevered member of said second unit including flexible endmost portions distal from said upright member of said second unit, said endmost portions and said cantilevered member of said first unit defining respective planes, said cantilevered member of said first unit being rigidly, integrally formed with said wall means and vertically spaced above said cantilevered member of said second unit, said cantilevered member of said second unit being biased to a first orientation slightly inclined from a second orientation wherein said respective planes defined by said cantilevered members are substantially parallel, said rearward segment including an upstanding support member of inverted, generally U-shaped configuration, presenting an uppermost bight and two spaced apart, support surface-engaging legs depending therefrom, said legs being rigidly fixed with respect to said wall means, the first of said legs being facially opposed to said upright member of said first unit, said first leg and flexible lowermost portions of said upright member of said first unit defining respective planes, said upright member of said first unit being biased to a first orientation slightly inclined from a second orientation wherein said respective planes defined by said first leg and lowermost portions of said upright member of said first unit are substantially parallel, said wall means being substantially perpendicular to the planar surface and substantially equally dividing said first unit, said second unit and said support member, respectively intersecting each at about the midway point along the length thereof so as to form four holding compartments, The first pair of said holding compartments defined by respective portions of said first leg, said upright member of said first unit and said wall means, the second pair of said holding compartments defined by respective portions of said cantilevered member of said second unit, said first unit and said wall means, the first pair of said holding compartments being substantially perpendicular to the support surface and the second pair of said holding compartments being substantially parallel to the support surface, so that when the user selectively inserts corner portions of the four bingo cards respectively into said four holding compartments, said cantilevered member of said second unit and said upright member of said first unit are tilted into the respective second orientations such that the four bingo cards are frictionally and releasably held by said assembly in positions suitable for visual inspection and manipulation by the user.

2. The multiple clip holding assembly of claim 1, further comprising:

a top clip of inverted, generally U-shaped configuration, presenting two spaced apart, facially opposed clip members connected at one end, each of said clip members including inwardly sloped, inwardly biased portions, such that when said top clip is selectively positioned on topmost portions of the two bingo cards inserted into the first pair of said holding compartments, said top clip adds further stability thereto.

3. A multiple clip holding assembly adapted to rest on a support surface for releasably holding at least two bingo cards so that the cards are held in a position suitable for a user to visually inspect and manipulate the cards in a convenient fashion, the assembly comprising:

a forward segment including first and second, mated, spaced apart units of inverted, generally L-shaped configuration, each of said units presenting an upright member and a cantilevered member extending from the upper end thereof, said cantilevered member of said second unit including flexible endmost portions distal from said upright member of said second unit, said endmost portions and said cantilevered member of said first unit defining respective planes and further defining a first holding compartment, said cantilevered member of said second unit being biased to a first orientation slightly inclined from a second orientation wherein said respective planes defined by said cantilevered members are substantially parallel;

a rearward segment including an upstanding support member of inverted, generally U-shaped configuration, said support member presenting an uppermost bight and first and second, spaced apart, support surface-engaging legs depending therefrom, the first of said legs being facially opposed to said upright member of said first unit so as to define a second holding compartment, said first leg and flexible lowermost portions of said upright member of said first unit defining respective planes, said upright member of said first unit being biased to a first orientation slightly inclined from a second orientation wherein said respective planes defined by said first leg and lowermost portions of said upright member of said first unit are substantially parallel; and wall means operably coupling said forward segment and said rearward segment such that said first holding compartment and said second holding compartment are transversely versely oriented with respect to each other so that when the user selectively inserts corner portions of the two bingo cards respectively into said first and second holding compartments, said cantilevered member of said second unit and said upright member of said first unit are tilted into the respective second orientations such that the two bingo cards are frictionally, releasably held by said assembly in positions suitable for visual inspection and manipulation by the user.

4. The multiple clip holding assembly of claim 3, wherein said wall means includes structure dividing said first unit, said second unit and said support member, respectively intersecting each at about the midway point along the length thereof so as to form said first and second holding compartments and third and fourth holding compartments, said first and said third holding compartments being substantially coplanar and defined by respective portions of said first leg, said upright member of said first unit and said wall means, said second and said fourth holding compartments being substantially coplanar and defined by respective portions of said cantilevered member of said second unit, said first unit and said wall means.

5. The multiple clip holding assembly of claim 4, further comprising:

a top clip of inverted, generally U-shaped configuration, presenting two spaced apart, facially opposed clip members connected at one end, each of said clip members including inwardly sloped, inwardly biased portions, such that when said top clip is selectively positioned on topmost portions of the two bingo cards inserted into said first and said third holding compartments, said top clip adds further stability thereto.

6. The multiple clip holding assembly of claim 3, wherein said upright member of said second unit presents a bottom, support surface-engaging end.

* * * * *